US005119557A

United States Patent [19]

Kaiko

[11] Patent Number: 5,119,557

[45] Date of Patent: Jun. 9, 1992

[54] SHAVE COUNTER

[76] Inventor: John Kaiko, 360 Maple Hill Ave., Newington, Conn. 06111

[21] Appl. No.: 637,493

[22] Filed: Jan. 3, 1991

[51] Int. Cl.[5] ..... B26B 19/48; B26B 19/38

[52] U.S. Cl. ..... 30/41.7; 30/41.8

[58] Field of Search ..... 30/41.7, 41.8, 32, 34.05

[56] References Cited

U.S. PATENT DOCUMENTS

| | | | |
|---|---|---|---|
| D. 218,669 | 9/1970 | Genaro et al. . | |
| 847,308 | 3/1907 | Baker et al. | 30/41.7 |
| 2,750,664 | 6/1956 | Merlo | 30/41.7 |
| 2,812,575 | 11/1957 | Abbott et al. | 30/41.7 |
| 2,885,993 | 5/1959 | Murphy | 30/41.7 |
| 3,229,659 | 1/1966 | Sciascia | 30/41.7 |
| 3,233,322 | 2/1966 | Sparagi et al. | 30/41.8 |
| 3,505,734 | 4/1970 | Iten . | |
| 3,648,365 | 3/1972 | Iten et al. . | |
| 4,208,984 | 6/1980 | Glanzman | 30/41.7 |

FOREIGN PATENT DOCUMENTS

| | | | |
|---|---|---|---|
| 454943 | 10/1936 | United Kingdom | 30/41.7 |

*Primary Examiner*—Douglas D. Watts
*Assistant Examiner*—Paul M. Heyrana, Sr.
*Attorney, Agent, or Firm*—Chilton, Alix & Van Kirk

[57] ABSTRACT

Disclosed herein is a safety razor having a blade, a handle mounted to the blade, and counting means attached to the handle for keeping track of the number of uses of a particular blade. The counter can be adapted for use on a disposable razor or on a razor having a replaceable blade.

8 Claims, 1 Drawing Sheet

SHAVE COUNTER

BACKGROUND OF THE INVENTION

The present invention generally relates to safety razors and more particularly relates to a device for counting the number of times a particular razor blade has been used.

Sometimes the user of a safety razor will attempt to shave with a dull blade, having forgotten how many times a particular blade had been used previously. This problem is especially common when several disposable razors of the same type are stored together, or when the blade on a non-disposable razor is not replaced at regular time intervals. The use of a dull blade generally will result in a poor shave, and may be uncomfortable.

SUMMARY OF THE INVENTION counting the number of shaves performed with a particular razor blade.

Another object of the invention is to provide a shave counter which either can be packaged with each new razor, or can be removed from one razor and placed on another.

A further object of the invention is to provide a shave counter that is particularly suitable for use with a conventional razor.

Another object of the invention is to provide a shave counter that is positioned on the razor handle such that it will aid the user in gripping the razor.

Yet another object of the invention is to provide a shave counter that is particularly suitable for use with a conventional non-disposable razor.

These and other objects will become apparent from the following description of the invention, the drawings and the claims.

DETAILED DESCRIPTION OF THE INVENTION

Figure 1:
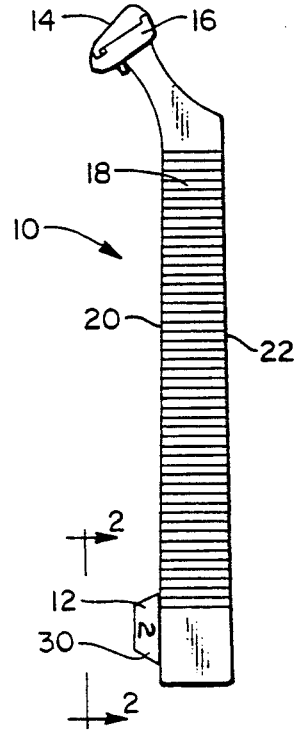
FIG. 1 is a side view of a safety razor incorporating a shave counter according to a first embodiment of the present invention.

Referring now to the drawings in detail wherein like numerals represent the same or like parts throughout, and referring first to FIGS. 1-4, disposable razor 10 having flexible plastic counter 12 is shown. T-shaped razor 10 is a conventional plastic disposable razor with the exception that counter 12 has been added. Razor 10 includes blade 14 held by encasement 16, which is attached to elongated handle 18. Handle 18 has front side

20 and back side 22, with slot 24 extending along the length of handle 18 on front side 20. Counter 12 having square head 30 and serrated stem 32 is removably mounted in slot 24 near the end of handle 18 opposite blade 14. One-piece counter 12 is manually removable from and replaceable on the handle 18 without disassembling the razor 10. In the preferred embodiment, counter 12 is positioned on the razor such that it enables the user to grip the razor more easily than if no counter is included on the handle.

Figure 2:
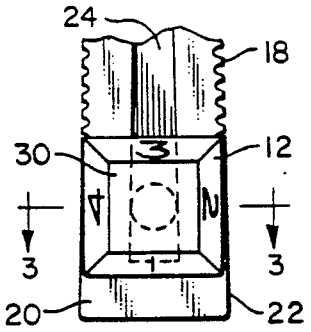
FIG. 2 is an enlarged fragmentary front view thereof, taken along lines 2—2 of FIG. 1.
Figure 3:
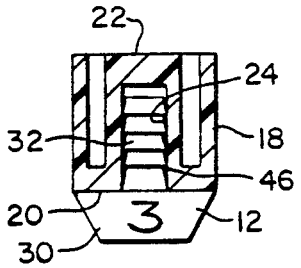
FIG. 3 is a cross-sectional view, taken along lines 3-3 of FIG. 2.

Head 30 has two pairs of opposite faces 34 having the numerals "1" to "4" imprinted thereon. Faces 34 are angled outward from center 36 of head 30 and downward toward stem 32 in order to provide for relatively easy manual rotation of square head 30. Stem 32 has a parallel series of circular ridges 46 which engage slot 24 and allow for rotation of head 30, with stem 32 serving as the axis of rotation. Slot 24 serves as an index along which each of the numbers "1" to "4" can be aligned. FIG. 2 depicts the number "3" aligned with the slot.

When counter 12 is used in a typical manner, the number "1" on counter 12 is aligned adjacent slot 24 before razor 10 is used. After razor 10 has been used once, counter 12 is rotated 90° in a clockwise direction, thereby aligning the number "2" with slot 12. Rotation of the counter continues in the same manner until after the fourth shave, at which time razor 10 can be disposed. Counter 12 can be removed from razor 10 and placed on another razor.

FIGS. 5-8 depict a second embodiment of a shave counter according to the present invention. T-shaped razor 60 is a conventional non-disposable razor, with the exception that counter 61 has been added. Razor 60 has blade 62 held in encasement 64 which is removably attached to handle 66. Encasement 64 can be removed by depressing tabs 68 on opposite first and second sides 70,72 of handle 66. Handle 66 has a substantially circular cross-section, and has a series of substantially parallel ribs 78 projected along the perimeter of a portion of handle 66 on first and second sides 70,72 and extending in the direction of rotation of the counting means.

Counter 61, a tubular band made of flexible plastic, is rotatably and removably mounted on handle 66. Counter 61 can be placed on handle 66 by slipping counter 61 on handle 66 from end 81. One-piece counter 61 is manually removable from and replaceable on the handle 66 without disassembling the razor 60. The diameter of generally smooth inner surface 82 of counter 61 is sufficient to snugly fit around handle 66, yet allow the user to manually slide counter 61 on and off handle 66 at end 81 and along the length of handle 66, as well as rotate counter 61 around the circumference of handle 66. In the preferred embodiment, counter 61 is positioned along the length of the handle such that it aids the user in gripping the razor.

On the outer surface of counter 61, a sequential series of numerals "1" to "6", are disposed equiangularly around the circumference. Counter 61 has knurled portion 90 extending around the circumference below the numbers to facilitate manual rotation.

Figure 8:
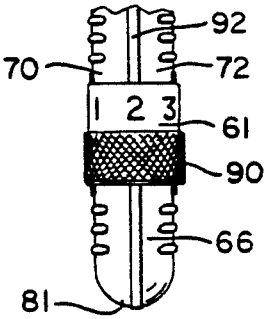
FIG. 8 is a back view of the razor shown in FIGS. 5 and 6.

As shown in FIG. 8, counter 61 can be rotated to sequentially align each of the numbers "1" to "6" with index 92, which extends in the direction of the length of the handle along back side 73 of handle 66.

Figure 4:
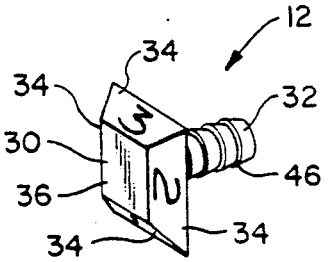
FIG. 4 is perspective view of the counter shown in FIGS. 1-3 according to the first embodiment of the present invention.
Figure 7:
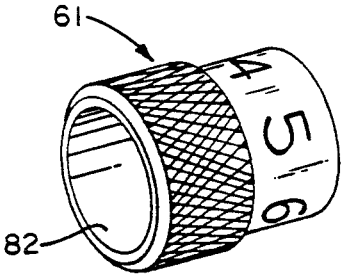
FIG. 7 is a perspective view of the counter shown in FIGS. 5 and 6.
Figure 5:
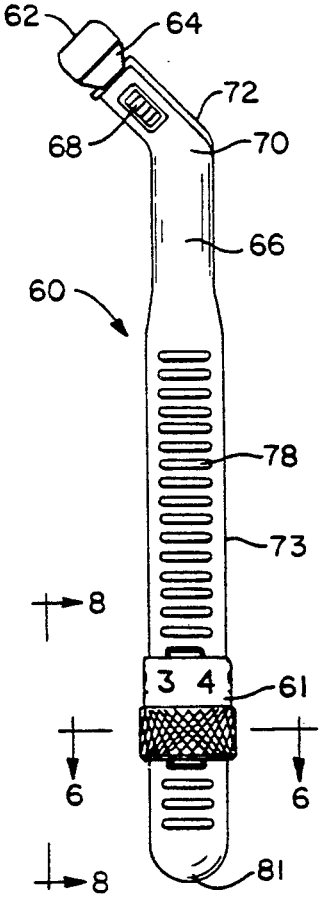
FIG. 5 is a side view of having a safety razor counter according to a second embodiment of the present invention.
Figure 6:
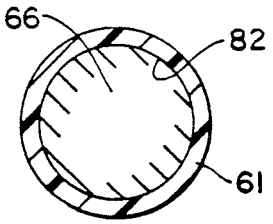
FIG. 6 is a cross-sectional view thereof, taken along lines 6—6 of FIG. 5.

It will be appreciated that the above description of the preferred embodiment is not intended to limit the scope of the invention. For example, while counters 12 and 61 shown in FIGS. 4 and 7 are removable, enabling the user to fasten them to different razors, it is within the scope of the invention to provide counters which are not readily removable from a razor. Slot 24 can be substituted by any suitable aperture. Head 30 can be rotatable relative to a stem that is stationary in relation to the handle. While the counter in FIG. 4 has four sides, counters with any number of sides, or counters with a head having a circular or oval cross section, are also within the scope of the invention. Letters or other distinguishable characters or marks can be used instead of numbers to keep track of the number of shaves. Similarly, the tubular counter shown in FIG. 7 may have any suitable range of numbers, depending, for example, upon the useful life of the blade. While the preferred embodiment depicts rotatable counters, the invention also encompasses slidable counters, and includes embodiments in which numerals or other marks are printed on the handle itself and an index is rotatably or slidably moved to be adjacent a particular numeral or mark. The index can be any suitable reference point on the razor, including, but not limited to an edge or end of the handle, a notch or a line. Other variations not specifically referred to also are within the scope of the invention.

What is claimed is:

1. A T-shaped safety razor, comprising:

a blade, an encasement supporting the blade, an elongated handle having an inner end connected to the encasement and an opposite outer end, and a counter on the handle for counting shaves, the counter including an index integrally formed on the handle and a one-piece, manually rotatable marker attached to the handle and alignable with the index, the marker being manually insertable on and manually removable from the handle without disassembling the razor, wherein one of the handle and the marker has a ribbed portion formed by a series of substantially parallel projecting ribs including peripheral contact surfaces having a contact outer diameter, and the other of the handle and the marker has a smooth inner side for engaging the contact surfaces of the ribbed portion, the engagement of the smooth, inner side and the contact surfaces supporting the marker on the handle while permitting rotation of the marker relative to the handle.

2. A razor according to claim 1, wherein the marker assists the user in gripping the razor.

3. A razor according to claim 1, wherein the ribbed portion is formed on the handle, and the marker is a flexible, plastic tubular band having a cylindrical bore, the cylindrical bore defining the smooth inner side.

4. A razor according to claim 3, wherein the marker assists the user in gripping the razor.

5. A razor according to claim 1, wherein the handle has a longitudinal slot defining the smooth inner side, and the marker is a one-piece, plastic part having a head portion and a stem, the stem including the ribbed portion.

6. A razor according to claim 5, wherein the head portion of the marker has numerals thereon that are alignable with the index.

7. A shave counter mountable on a safety razor having an elongated handle, the counter comprising:

a one-piece plastic marker having means including a rotatable serrated stem and a head with an annular arrangement of numerals thereon, the stem being adapted for manually inserting the marker on the handle, manually removing the marker from the handle and rotating the marker on the handle of the razor all without disassembling the razor.

8. A shave counter mountable on a safety razor having an elongated handle including an outer end and a ribbed portion formed by a series of longitudinally spaced, transversely extending substantially parallel projecting ribs including intermittent peripheral contact surfaces having a constant diameter, the counter comprising:

a one-piece plastic marker including a flexible, tubular band having a series of numerals thereon and a cylindrical bore including a smooth inner side for receiving the handle, holding the band on the ribbed portion of the handle in engagement with the intermittent peripheral contact surfaces, and permitting the band to be rotatably adjusted on the handle, the tubular band being manually insertable on and removable from the ribbed portion of the handle by sliding the band on and off the outer end of the handle without disassembling the razor.

* * * * *

UNITED STATES PATENT AND TRADEMARK OFFICE

CERTIFICATE OF CORRECTION

PATENT NO. : 5,119,557

DATED : June 9, 1992

INVENTOR(S) : John Kaiko

It is certified that error appears in the above-indentified patent and that said Letters Patent is hereby corrected as shown below:

Column 3, line 43 change "contact" to --constant --.

Signed and Sealed this

First Day of February, 1994

Bruce Lehman

*Attest:*

BRUCE LEHMAN

*Attesting Officer*

*Commissioner of Patents and Trademarks*